US006381923B1

(12) United States Patent
Plüschow et al.

(10) Patent No.: US 6,381,923 B1
(45) Date of Patent: May 7, 2002

(54) PACKAGING MACHINE

(75) Inventors: Dieter Plüschow; Bernd Hähnel, both of Stutensee (DE)

(73) Assignee: IWK Verpackungstechnik GmbH, Stutensee (DE)

( * ) Notice: Subject to any disclaimer, the term of this patent is extended or adjusted under 35 U.S.C. 154(b) by 0 days.

(21) Appl. No.: 09/559,055

(22) Filed: Apr. 27, 2000

(30) Foreign Application Priority Data

May 6, 1999 (DE) ..... 199 20 900

(51) Int. Cl.[7] ..... B65B 7/00; B65B 7/22

(52) U.S. Cl. ..... 53/376.3; 493/156; 493/183; 493/475

(58) Field of Search ..... 53/377.7, 376.4, 53/377.3; 493/156, 159, 183, 475, 478, 479

(56) References Cited

U.S. PATENT DOCUMENTS

| | | | | | |
|---|---|---|---|---|---|
| 3,184,898 | A | * | 5/1965 | Berney | 53/382 |
| 3,724,185 | A | * | 4/1973 | Berney | 53/186 |
| 3,986,711 | A | * | 10/1976 | Anikanov et al. | 270/77 |
| 4,106,265 | A | * | 8/1978 | Aterianus | 53/180 |
| 4,530,686 | A | | 7/1985 | Everson | |
| 5,279,098 | A | * | 1/1994 | Fukuda | 53/451 |
| 5,685,131 | A | * | 11/1997 | Spatolisano et al. | 53/550 |
| 5,778,641 | A | * | 7/1998 | Simionato | 53/551 |
| 5,839,254 | A | * | 11/1998 | Chen | 53/377.2 |
| 6,070,396 | A | * | 6/2000 | Rinaldi et al. | 53/504 |
| 6,138,442 | A | * | 10/2000 | Howard et al. | 53/447 |

FOREIGN PATENT DOCUMENTS

| | | |
|---|---|---|
| CH | 4 74 405 | 8/1969 |
| DE | 695 02 850 | 10/1998 |
| DE | 198 01 194 | 7/1999 |
| GB | 2 144 391 | 3/1985 |

* cited by examiner

*Primary Examiner*—John Sipos
*Assistant Examiner*—Hemant M. Desai
(74) *Attorney, Agent, or Firm*—Paul Vincent

(57) ABSTRACT

A packaging machine comprises a folding box transporting device and a closing device for alignment and insertion of the closing flaps of a folding box, wherein the closing device supports at least one closing tool which rotates, via a drive and a gearing, while maintaining its orientation. The gearing is a planetary gearing which ensures precise motion of the closing tools even at high packaging machine cycle frequencies. The planetary support can thereby be connected to an intermediate shaft surrounded by a coaxially disposed hollow drive shaft, wherein the hollow drive shaft is borne for rigid rotation along with the intermediate shaft but in an axially displaceable fashion to permit axial or vertical adjustment of the planetary gearing and therefore of the closing tools.

5 Claims, 2 Drawing Sheets

PACKAGING MACHINE

This application claims Paris Convention priority of DE 199 20 900 filed May 6, 1999 the complete disclosure of which is hereby incorporated by reference.

BACKGROUND OF THE INVENTION

The invention concerns a packaging machine comprising a folding box transporting means and a closing device for aligning and inserting the closure flaps of a folding box, wherein the closing device bears at least one closing tool which rotates via a drive and a gearing while maintaining its orientation.

A packaging machine for packing a product into a folding box usually has an endless circulating folding box chain and an endless circulating transport device for the products, e.g. a so-called product chain. The motions of the folding box chain and the product chain are synchronized such that the product can be inserted into the folding box transverse to the direction of motion of the chains. After insertion of the products, the lateral closure flaps of the folding box must be aligned and inserted in a subsequent operating step using a so-called closing device comprising one or more closing tools of conventional construction which carry out a circulating rotary motion in a plane essentially parallel to the surface of the folding box chain while maintaining their orientation relative to the folding box chain and therefore substantially exercising a translational motion along a closed curve. The drive belt or a drive chain often used in packaging machines is normally used as a drive element for this motion and drives a belt wheel whose rotary motion is translated via a crank gear into the above mentioned circulating motion of the closing tools. Practice has shown that the crank is susceptible to malfunction and, in particular, to jamming thereby impairing or even seriously disturbing operation of the packaging machine. Moreover, a crank gear has relatively large moving masses on long lever arms which generate large inertial forces at high packaging machine cycle times and associated high crank gear speeds leading to very unsteady and imprecise motion of the closing tools.

It is the underlying purpose of the invention to generate a closing device in a packaging machine of the mentioned kind which guarantees precise motion of the closing tools even at high packaging machine cycle frequencies.

SUMMARY OF THE INVENTION

This object is achieved in a packaging machine of the mentioned kind by using a planetary gearing. This gearing can be compact in structure and exhibit inertial forces during operation of the planetary gearing which are considerably smaller than those of a crank gearing, such that precise closing motion of the closing tools can be achieved even for high planetary gear speeds.

The planetary gearing preferably comprises a rotary driven planetary support with an intermediate wheel borne thereon which turns on a stationary sun wheel and drives a drive wheel rotatably borne on the planetary support whose output shaft has a holder for the closing tool. To enable easy replacement of the closing tool(s) when required, the closing tools are preferably mounted to the holder via a releasable clamping device.

In accordance with a preferred embodiment of the invention, the drive motion of the toothed belt or chain is transmitted to a hollow drive shaft on which the drive belt wheel is integrally formed or to which it is mounted. The hollow drive shaft is rotatably borne in the machine tool and is connected to and rotates without slipping along with an intermediate shaft coaxially disposed therein. The hollow drive shaft and the intermediate shaft thereby rotate as a unit. The planetary support borne by the intermediate shaft is rotatably driven via the toothed belt.

The closing device must be adapted to format changes in the folding boxes to be closed. Towards this end, the intermediate shaft is disposed in the hollow drive shaft in an axially displaceable fashion such that axial relative adjustment can change the vertical position of the planetary support and thereby of the closing tools. Adjustment of the planetary support must be accompanied by a corresponding axial adjustment of the sun wheel. In accordance with the invention, this can be achieved in a structurally advantageous manner when the intermediate shaft is also a hollow shaft, wherein a supporting bar extends through the intermediate shaft and bears the sun wheel at one end thereof. In a further development of the invention, an adjustment device can displace the planetary gearing as a unit along with the intermediate shaft and the supporting bar in an axial direction relative to the hollow drive shaft which is, in turn, borne for rotation without axial displacement in the packaging machine. The adjustment device can thereby be e.g. a spindle nut unit which can be adjusted manually or by a motor-drive and which securely maintains the set position.

Further details and features of the invention can be extracted from the following description of an embodiment with reference to the drawings.

DESCRIPTION OF THE PREFERRED EMBODIMENT

Figure 1:
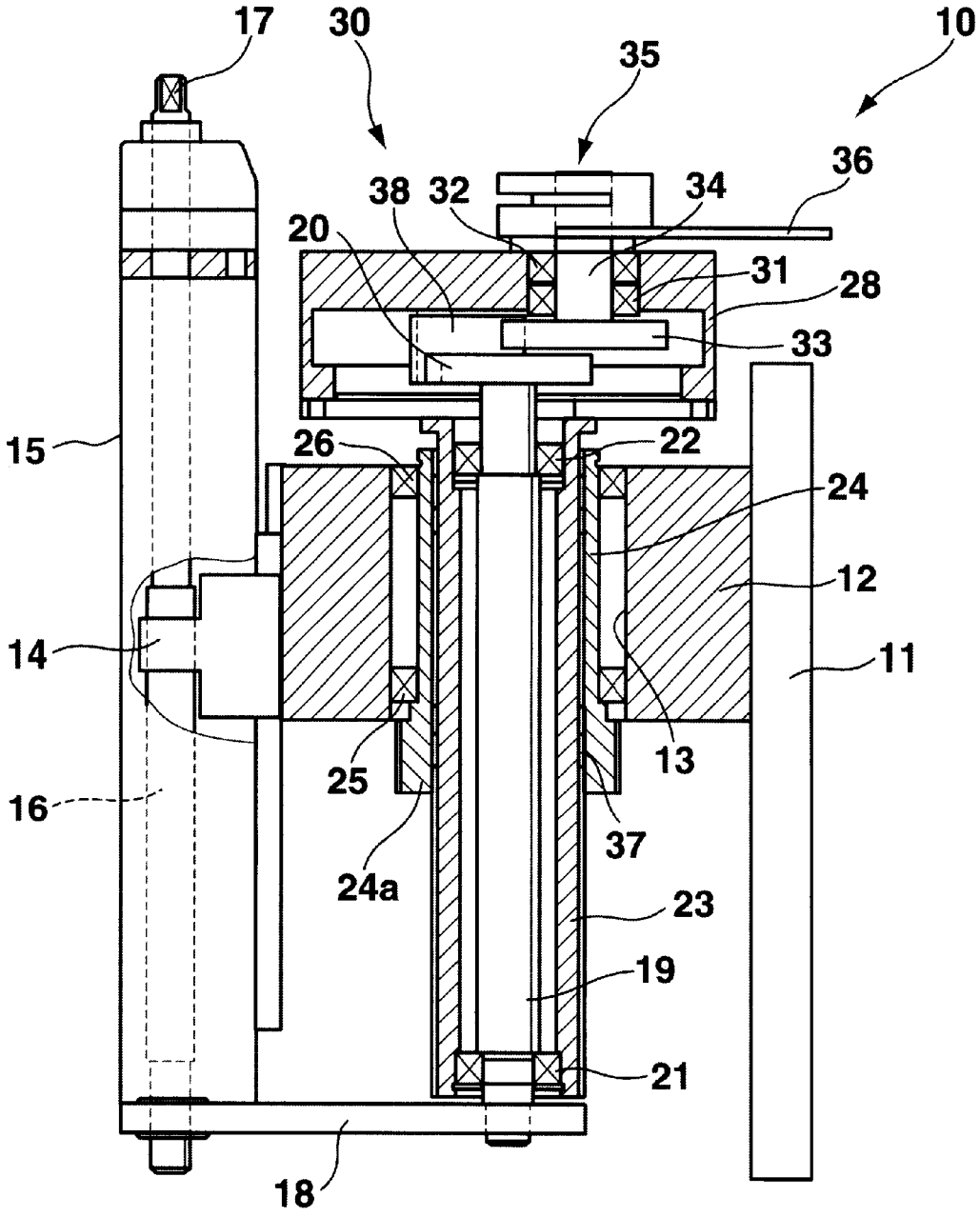
FIG. 1 shows a vertical section through a closing device in accordance with the invention.
Figure 2:
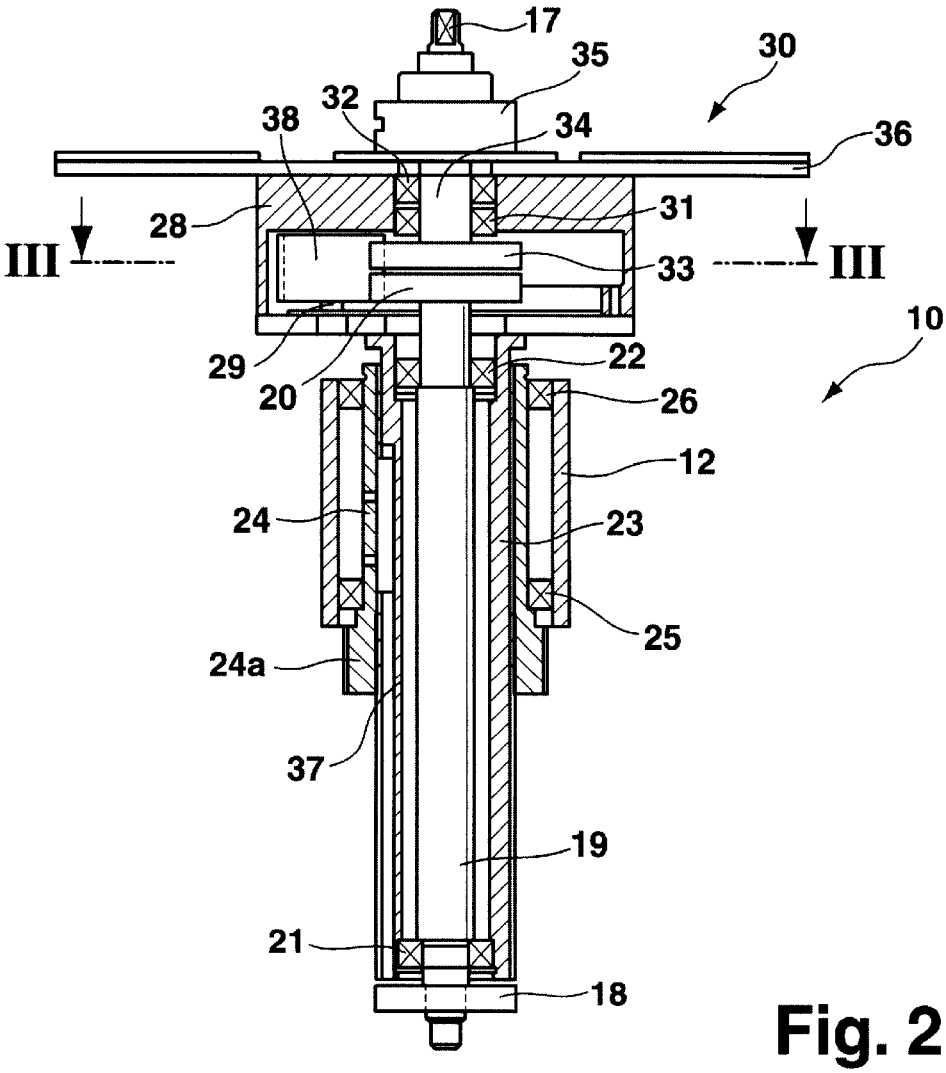
FIG. 2 shows a vertical section through the closing device, rotated by 90° with respect to FIG. 1.
Figure 3:
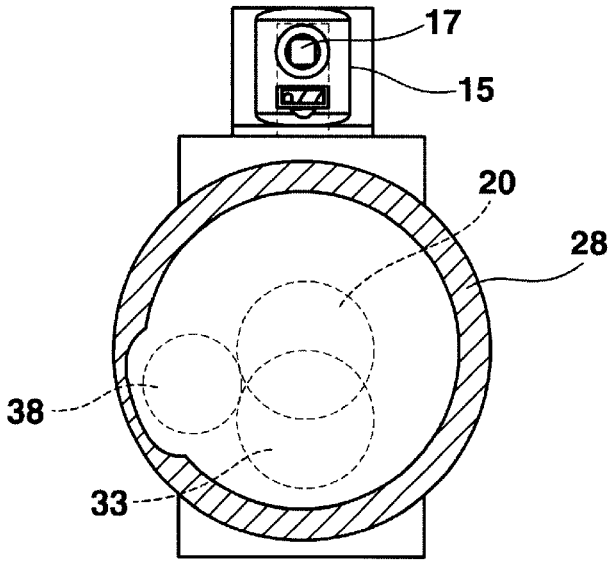
FIG. 3 shows the section III—III of FIG. 2.

The closing device 10 of a packaging machine shown in FIGS. 1 through 3 comprises a console 12, disposed on a stationary component 11 of the machine, and comprising a vertical bore 13 bearing a hollow drive shaft 24 via vertically spaced rotary bearings 25 and 26 in a rotatable, however, axially undisplaceable fashion. The lower end of the hollow drive shaft 24 comprises an integrally formed drive belt wheel 24*a* about which a toothed belt (not shown) is disposed for rotating the hollow drive shaft 24.

An intermediate shaft 23 penetrates coaxially through the hollow drive shaft 24 and is also formed as a hollow shaft connected via a feather key 37 or an axial groove to and for mutual rotation with the hollow drive shaft 24. The intermediate shaft 23 and the hollow drive shaft 24 rotate together as a unit but can be axially displaced with respect to each other. The upper end of the intermediate shaft 23 bears a casing-like planetary support 28 bearing an intermediate wheel 38 via an axle 29. A supporting bar 19 extends coaxially within the intermediate shaft 23 on which the intermediate shaft 23 is rotatably supported via axially spaced pivot bearings 21 and 22. The upper side of the supporting bar 19 projects beyond the intermediate shaft 23 and protrudes into the planetary support 28. A sun wheel 20, upon which the intermediate wheel 38 turns, is rigidly mounted at the upper end of the supporting bar 19.

An output shaft 34 is rotatably supported, via bearings 31 and 32, on the upper side of the planetary support 28, the lower side of which is disposed inside the planetary support 28 and bears an output toothed wheel 33 engaging the intermediate wheel 38. The output shaft 34 has a holder 35 for closing tools 36 at the upper side of the planetary support 28.

The lower end of the supporting bar 19 projects beyond the lower side of the intermediate shaft 23 and is connected to a holding bracket 18 which, at its end facing away from the supporting bar 19, bears a threaded spindle 16 accommodated in a casing 15, extending essentially parallel to the supporting bar 19, and having an actuating section 17 at its upper end by means of which a user can pivot the threaded spindle 16 manually or in a motor-driven fashion. The threaded spindle 16 engages a nut-like threaded section 14 of the console 12.

The toothed belt (not shown) rotates the toothed belt wheel 24*a* and the hollow drive shaft 24, thereby correspondingly rotating the intermediate shaft 23 via its non-rotatable engagement therewith. The planetary support 28 also rotates, together with the intermediate shaft 23, whereby its intermediate wheel 38 turns on the sun wheel 20 to thereby turn the output toothed wheel 33, engaged in the intermediate wheel 38. This planetary gearing 30 causes the closing tools 36, releasably mounted on the holder 35, to rotate about the central axis of the hollow drive shaft 24 superimposed on the rotation of the output toothed wheel 33 such that the closing tools 36 do not change their orientation relative to the packaging machine.

To adjust the height of the closing tools, the user turns the threaded spindle 16 via the actuating section 17 in the desired manner to vertically displace the threaded spindle. The holding bracket 18 and the supporting bar 19 fixedly mounted thereon, its sun wheel 20 and the intermediate shaft 23 borne on the supporting bar 19 in an axially non-displaceable manner, are thereby adjusted vertically along with the planetary gearing 30, wherein the intermediate shaft 23 exerts an axial relative displacement with respect to the hollow drive shaft 24 held in an axially non-displaceable fashion in the console 12.

We claim:

1. A closing device for aligning and inserting closure flaps of a folding box disposed on a folding box transporting means in a packaging machine, the device comprising:

a stationary frame, drive means mounted to said frame;

a planetary gearing connected to said drive means;

a closing tool mounted to said planetary gearing and communicating with the folding box to align and insert the closure flaps, wherein said closing tool rotates while maintaining its orientation relative to the folding box; and an intermediate shaft surrounded by a coaxially disposed hollow drive shaft, said hollow drive shaft borne on said frame for rotation along with said intermediate shaft and for axial displacement relative thereto, wherein said planetary support is borne on said intermediate shaft.

2. The closing device of claim 1, wherein said planetary gearing comprises a planetary support driven for rotation by said drive means, a sun wheel connected to said frame to prevent rotation thereof, an intermediate wheel borne on said planetary support and engaging said sun wheel to turn about said sun wheel, an output wheel rotatably borne on said planetary support and engaging said intermediate wheel, said output wheel having an output shaft, and a holder communicating with said output shaft, said holder bearing said closing tool.

3. The closing device of claim 2, further comprising a detachable clamping device mounting said closing tool to said holder.

4. The closing device of claim 1, wherein said intermediate shaft is a hollow shaft, and further comprising a supporting bar extending through said intermediate shaft and bearing said sun wheel at one of its ends.

5. The closing device of claim 4, further comprising an adjustment device for axial displacement of said planetary gearing, as a unit together with said intermediate shaft and said supporting bar, relative to said hollow drive shaft, wherein said hollow drive shaft is borne on said frame in a rotatable however axially non-displaceable manner.

* * * * *